US011393376B2

(12) United States Patent
Honda

(10) Patent No.: US 11,393,376 B2
(45) Date of Patent: Jul. 19, 2022

(54) REFRESH RATE SETTING APPARATUS, REFRESH RATE SETTING METHOD, AND NON-TRANSITORY STORAGE MEDIUM

(71) Applicant: SHARP KABUSHIKI KAISHA, Sakai (JP)

(72) Inventor: Takuya Honda, Sakai (JP)

(73) Assignee: SHARP KABUSHIKI KAISHA, Sakai (JP)

( * ) Notice: Subject to any disclaimer, the term of this patent is extended or adjusted under 35 U.S.C. 154(b) by 0 days.

(21) Appl. No.: 17/175,334

(22) Filed: Feb. 12, 2021

(65) Prior Publication Data

US 2021/0256891 A1 Aug. 19, 2021

(30) Foreign Application Priority Data

Feb. 14, 2020 (JP) ..... JP2020-023829

(51) Int. Cl.
*G09G 3/20* (2006.01)

(52) U.S. Cl.
CPC ..... *G09G 3/20* (2013.01); *G09G 2320/0261* (2013.01)

(58) Field of Classification Search
None
See application file for complete search history.

(56) References Cited

U.S. PATENT DOCUMENTS

2013/0141642 A1* 6/2013 Wu ..... G09G 5/363 348/441
2014/0368519 A1 12/2014 Wood et al.
2016/0078838 A1* 3/2016 Huang ..... G09G 5/00 345/520
2016/0275916 A1* 9/2016 Glen ..... G09G 5/395
2018/0144724 A1 5/2018 Wood et al.
2018/0261190 A1* 9/2018 Yi ..... G09G 5/363
2019/0355331 A1 11/2019 Wood et al.
2021/0096775 A1* 4/2021 Park ..... G01K 3/005
2021/0225320 A1* 7/2021 Sin ..... G09G 5/003
2021/0248973 A1* 8/2021 Jeon ..... G09G 5/14

FOREIGN PATENT DOCUMENTS

JP 2016-529534 A 9/2016

* cited by examiner

*Primary Examiner* — Aneeta Yodichkas
(74) *Attorney, Agent, or Firm* — ScienBiziP, P.C.

(57) ABSTRACT

A refresh rate setting apparatus for use in a portable terminal, comprises a first setting unit configured to, when an application program is started, set a refresh rate of a display of the portable terminal to a first refresh rate equal to or higher than 90 Hz; a determination unit configured to determine whether the first refresh rate is an integer multiple of a frame rate of the application program; and a second setting unit configured to, in a case where the determination unit determines that the first refresh rate is not an integer multiple of the frame rate, set the refresh rate to a second refresh rate according to whether values settable as the refresh rate include one or more values each equal to an integer multiple of the frame rate.

15 Claims, 3 Drawing Sheets

| NAME OF APPLICATION PROGRAM | CUMULATIVE EXECUTION TIME (hr) | MAXIMUM FRAME RATE (fps) | SECOND REFRESH RATE (Hz) | DETERMI-NATION DATE | UPDATE DATE OF APPLICATION PROGRAM |
|---|---|---|---|---|---|
| 1 | 100 | 144 | 144 | 2020/1/1 | 2019/1/1 |
| 2 | 50 | 40 | 120 | 2019/11/15 | 2018/1/1 |
| 3 | 25 | 45 | 90 | 2020/2/15 | 2020/2/14 |

REFRESH RATE SETTING APPARATUS, REFRESH RATE SETTING METHOD, AND NON-TRANSITORY STORAGE MEDIUM

BACKGROUND

1. Field

The present disclosure relates to a refresh rate setting apparatus, a refresh rate setting method, and a non-transitory storage medium.

2. Description of the Related Art

In recent years, efforts have been made to develop application programs for running on portable terminals (for example, smartphones, tablet devices, portable game machines, etc.). The application programs are developed without assuming to be used on a specific portable terminal. Therefore, frame rates may vary depending on the application programs. In general, users do not know frame rates of application programs. On the other hand, the upper limit of the display refresh rate of portable terminals is gradually increasing. Situations (1) and (2) described below may be problems with such portable terminals.

(1) Even in a case where the frame rate of an application program is equal to an aliquot of the refresh rate of a display, the frame rate of the application program may vary which may cause an image movement on a display screen to be jerky.

(2) In a case where the frame rate of an application program is not equal to an aliquot of the refresh rate of a display, an image movement on a display screen may be jerky.

To handle the above problems, Japanese Unexamined Patent Application Publication (Translation of PCT Application) No. 2016-529534 discloses a technique for managing a dynamic adjustment of a refresh rate of a computer display. In the technique disclosed in Japanese Unexamined Patent Application Publication (Translation of PCT Application) No. 2016-529534, an operating system prescribes at least two playback modes: one or more custom modes that can be selected by the application program; and a standard mode which is set as a system default mode predictable by application programs. The operating system provides an application programming interface that allows application programs to request a use of a custom mode.

In a case where the request for use of the custom mode by the application program is accepted, the application program presents a display frame based on the custom mode. The operating system stores timing data of buffering frames specifying a method of reproducing frames for each of the standard mode and the custom mode. When a transition back to the standard mode occurs, the operating system handles the transition according to the timing data to properly present video frames until the application program stops generating video frames in the custom mode.

However, the technique disclosed Japanese Unexamined Patent Application Publication (Translation of PCT Application) No. 2016-529534 has problems described below. In a case where the refresh rate of the display is adjusted while the application program is running on the portable terminal, a jerky movement may occur in an image displayed on the display screen. In the technique disclosed in Japanese Unexamined Patent Application Publication (Translation of PCT Application) No. 2016-529534, the refresh rate of the display is adjusted while the application program is running, which may make it difficult to maintain high display quality.

In view of the above, the present disclosure provides a refresh rate setting apparatus, a refresh rate setting method, and a non-transitory storage medium, capable of achieving an improved display quality.

SUMMARY

In view of the above, an aspect of the present disclosure provides a refresh rate setting apparatus for use in a portable terminal, including a first setting unit configured to, when an application program is started, set a refresh rate of a display of the portable terminal to a first refresh rate equal to or higher than 90 Hz, a determination unit configured to determine whether the first refresh rate is an integer multiple of a frame rate of the application program, and a second setting unit configured to, in a case where the determination unit determines that the first refresh rate is not an integer multiple of the frame rate, set the refresh rate to a second refresh rate according to whether values settable as the refresh rate include one or more values each equal to an integer multiple of the frame rate.

An aspect of the present disclosure provides a method for setting a refresh rate of a portable terminal, including when an application program is started, setting a refresh rate of a display of the portable terminal to a first refresh rate equal to or higher than 90 Hz, determining whether the first refresh rate is an integer multiple of a frame rate of the application program, in a case where it is determined that the first refresh rate is not an integer multiple of the frame rate, further determining whether values settable as the refresh rate include one or more values each equal to an integer multiple of the frame rate, in a case where the values settable as the refresh rate do not include an integer multiple of the frame rate and the frame rate is equal to or higher than 60 fps, setting, as a second refresh rate, a value that is lower than the frame rate and is highest among values settable as the refresh rate, in a case where the values settable as the refresh rate do not include an integer multiple of the frame rate and the frame rate is lower than 60 fps, setting the second refresh rate to 60 Hz, and when the application program is started for the next time, setting the second refresh rate as the refresh rate.

DESCRIPTION OF THE EMBODIMENTS

Embodiments of the present disclosure are described below with reference to drawings. The embodiments described below are examples of implementations of the present disclosure, and it is possible to make various modifications or changes depending on configurations or conditions of apparatuses to which the present disclosure is applied. That is, the present disclosure is not limited to the embodiments described below. In descriptions given below with reference to drawings, constituent elements similar among embodiments are denoted by similar reference symbols, and duplicated explanations thereof may be omitted.

Portable Terminal 1

Figure 1:
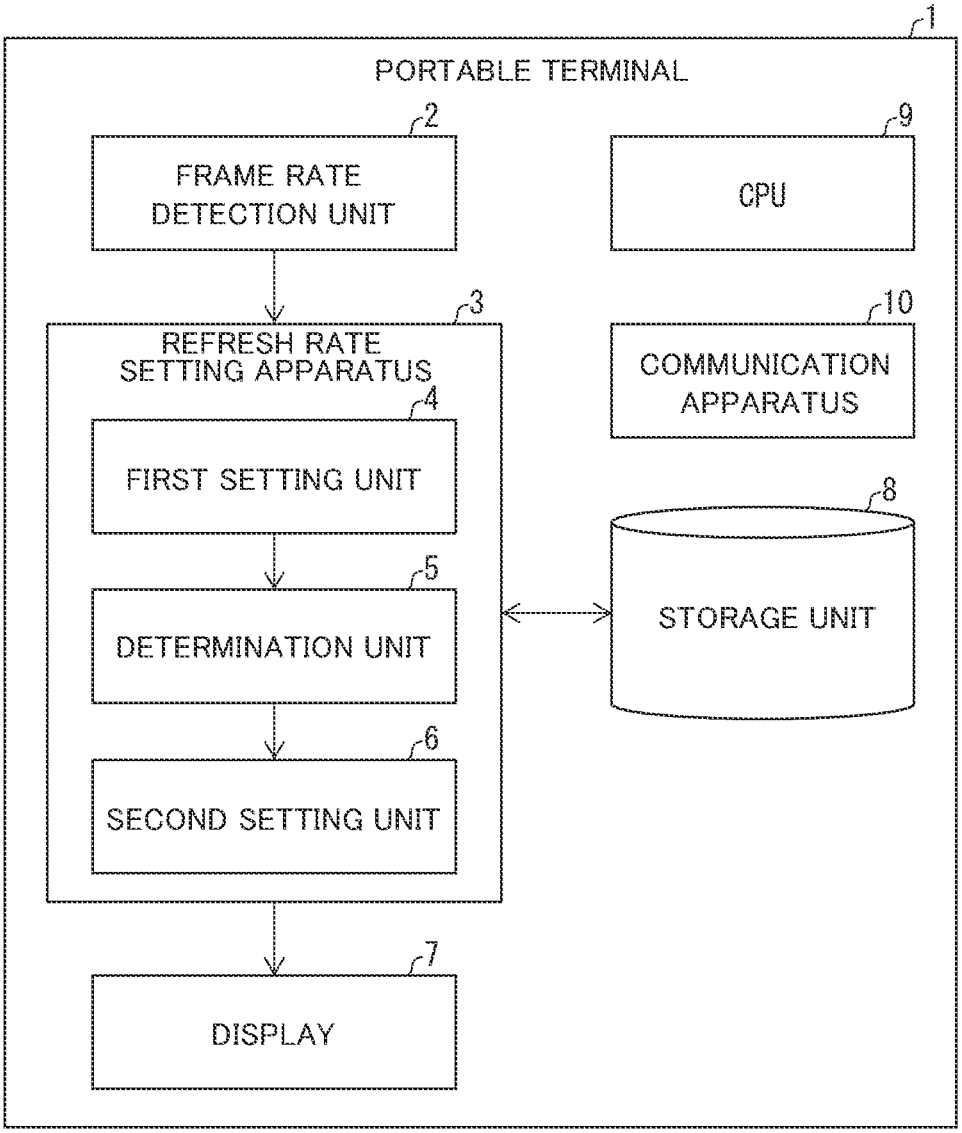
FIG. 1 is a schematic diagram illustrating a configuration of a portable terminal according to the present disclosure.

Referring to FIG. 1, a portable terminal 1 accordance to the present disclosure is described below.

FIG. 1 is a schematic diagram illustrating a configuration of a portable terminal 1 according to the present disclosure. The portable terminal 1 may be a smartphone, a tablet terminal, a PDA, a digital camera, a portable game device, or the like. The portable terminal 1 includes a frame rate detection unit 2, a refresh rate setting apparatus 3, a display 7, a storage unit 8, a CPU 9, and a communication apparatus 10.

The frame rate detection unit 2 detects a frame rate of an application program from a drawing frame rate of the application program started on the portable terminal 1. In a case where a change occurs in the frame rate, the frame rate after the change can be detected. The frame rate detection unit 2 can also detect other information about the application program (for example, the name of the application program, the update date of the application program, and/or the like) as well as the frame rate of the application program. The frame rate detection unit 2 outputs the detected information to the refresh rate setting apparatus 3. The frame rate detection unit 2 may store the detected information in the storage unit 8 (described later).

The application programs discussed here may be various application programs that provide moving images or still images. Specific examples of application programs are a game application program, an application program that provides a moving image via a moving image distribution service, and a cooking-related application program.

The refresh rate setting apparatus 3 is an apparatus configured to set the refresh rate of the display 7. The refresh rate setting apparatus 3 includes a first setting unit 4, a determination unit 5, and a second setting unit 6. The refresh rate setting apparatus 3 may include a storage unit 8.

When an application program is started, the first setting unit 4 sets the refresh rate of the display 7 to a first refresh rate equal to or higher than 90 Hz (for example, 90 Hz, 120 Hz, 144 Hz, or 150 Hz). The first setting unit 4 outputs the set first refresh rate to the determination unit 5.

The determination unit 5 acquires the frame rate of the application program from the frame rate detection unit 2 and acquires the first refresh rate from the first setting unit 4. The determination unit 5 then makes various determinations, for example, as to whether the refresh rate of the display 7 is an integer multiple (for example, 1×, 2×, 3×, etc.) of the frame rate of the application program X In accordance with a determination result made by the determination unit 5, the second setting unit 6 sets the second refresh rate. The second refresh rate is set as the refresh rate of the display 7.

The determination made by the determination unit 5 and the setting of the second refresh rate made accordingly by the second setting unit 6 are described below.

First, the determination unit 5 determines whether the first refresh rate is an integer multiple of the frame rate of the application program. In a case where it is determined that the first refresh rate is an integer multiple of the frame rate of the application program, the determination unit 5 outputs this result of the determination to the second setting unit 6. The second setting unit 6 sets the second refresh rate to a value that is an integer multiple of the frame rate and is lower than or equal to the first refresh rate. The second setting unit 6 stores the set second refresh rate in the storage unit 8 (described later).

For example, in a case where the first refresh rate is 120 Hz and the frame rate is 60 fps, the second setting unit 6 sets the second refresh rate to 60 Hz or 120 Hz.

On the other hand, there is a possibility that the determination unit 5 may determine that the first refresh rate is not an integer multiple of the frame rate of the application program. This situation may occur, for example, when the first refresh rate is 120 Hz and the frame rate is 50 fps. In this case, the determination unit 5 determines whether the settable refresh rates include one or more values equal to integer multiples of the frame rate.

In a case where the determination unit 5 determines that the settable refresh rates include one or more values equal to integer multiples of the frame rate, the second setting unit 6 sets the second refresh rate to a value that is an integer multiple of the frame rate and is highest among values settable as the refresh rate. The second setting unit 6 stores the set second refresh rate in the storage unit 8. For example, in a case where the first refresh rate is 120 Hz, the frame rate is 90 fps, and the refresh rate of the display 7 is allowed to be set to 90 Hz, the second setting unit 6 sets the second refresh rate to 90 Hz.

In a case where the determination unit 5 determines that settable refresh rates include no value equal to an integer multiple of the frame rate, the determination unit 5 determines whether the frame rate is equal to or higher than 60 fps.

In a case where the determination unit 5 determines that the frame rate is equal or higher than 60 fps, the second setting unit 6 sets the second refresh rate to a value that is smaller than the frame rate and is highest among values settable as the refresh rate. The second setting unit 6 stores the set second refresh rate in the storage unit 8. For example, in a case where the first refresh rate is 120 Hz, the frame rate is 90 fps, and the refresh rate of the display 7 is allowed to be set to 80 Hz, the second setting unit 6 sets the second refresh rate to 80 Hz.

In a case where the determination unit 5 determines that the frame rate is smaller than 60 fps, the second setting unit 6 sets the second refresh rate to 60 Hz. The second setting unit 6 stores the set second refresh rate in the storage unit 8. For example, in a case where the first refresh rate is 120 Hz, the frame rate is 45 fps, and the refresh rate of the display 7 is allowed to be set to 80 Hz, the second setting unit 6 sets the second refresh rate to 60 Hz.

As described above, the second setting unit 6 sets the second refresh rate and stores the set second refresh rate in the storage unit 8. When the application program X is started for the next time, the refresh rate setting apparatus 3 (the first setting unit 4 or the second setting unit 6) sets the refresh rate to the second refresh rate.

The display 7 may be a liquid crystal display, an organic EL display, or the like. The display 7 displays images and moving images of the application program.

The storage unit 8 stores data indicating the second refresh rate. The storage unit 8 may store data indicating at least one of the following: a name of the application program; a cumulative execution time of the application program; a maximum frame rate; a determination date when the determination unit 5 makes a determination; and an update date of the application program. The storage unit 8 may store a control program executed by the CPU 9, a data table, a program, data that a user wants to store, and/or the like. The storage unit 8 may be a known semiconductor memory or the like.

The CPU 9 is a system control unit of the portable terminal 1, and controls the entire portable terminal 1.

The communication apparatus 10 has general functions for communicating using wireless LAN or Bluetooth (registered trademark), or the like. The communication apparatus 10 may communicate using a wired or wireless method. The communication apparatus 10 is also used to download an application program.

According to the above-described technique, regardless of whether the first refresh rate is an integer multiple of the frame rate of the application program, the refresh rate setting apparatus 3 sets the refresh rate of the display 7 to a value that is equal to or close to the frame rate of the application program. As a result, the portable terminal 1 has a reduction in jerky movement in an image displayed on the display screen. Thus, the refresh rate setting apparatus 3 can improve the display quality of the portable terminal 1.

Furthermore, the refresh rate setting apparatus 3 determines the refresh rate of the display 7 when the application program is started rather than when the application program is running. This makes it possible for the portable terminal 1 to achieve a further reduction in jerky movement in an image displayed on the display screen. Thus, the refresh rate setting apparatus 3 can further improve the display quality of the portable terminal 1.

Flowchart

Figure 2:
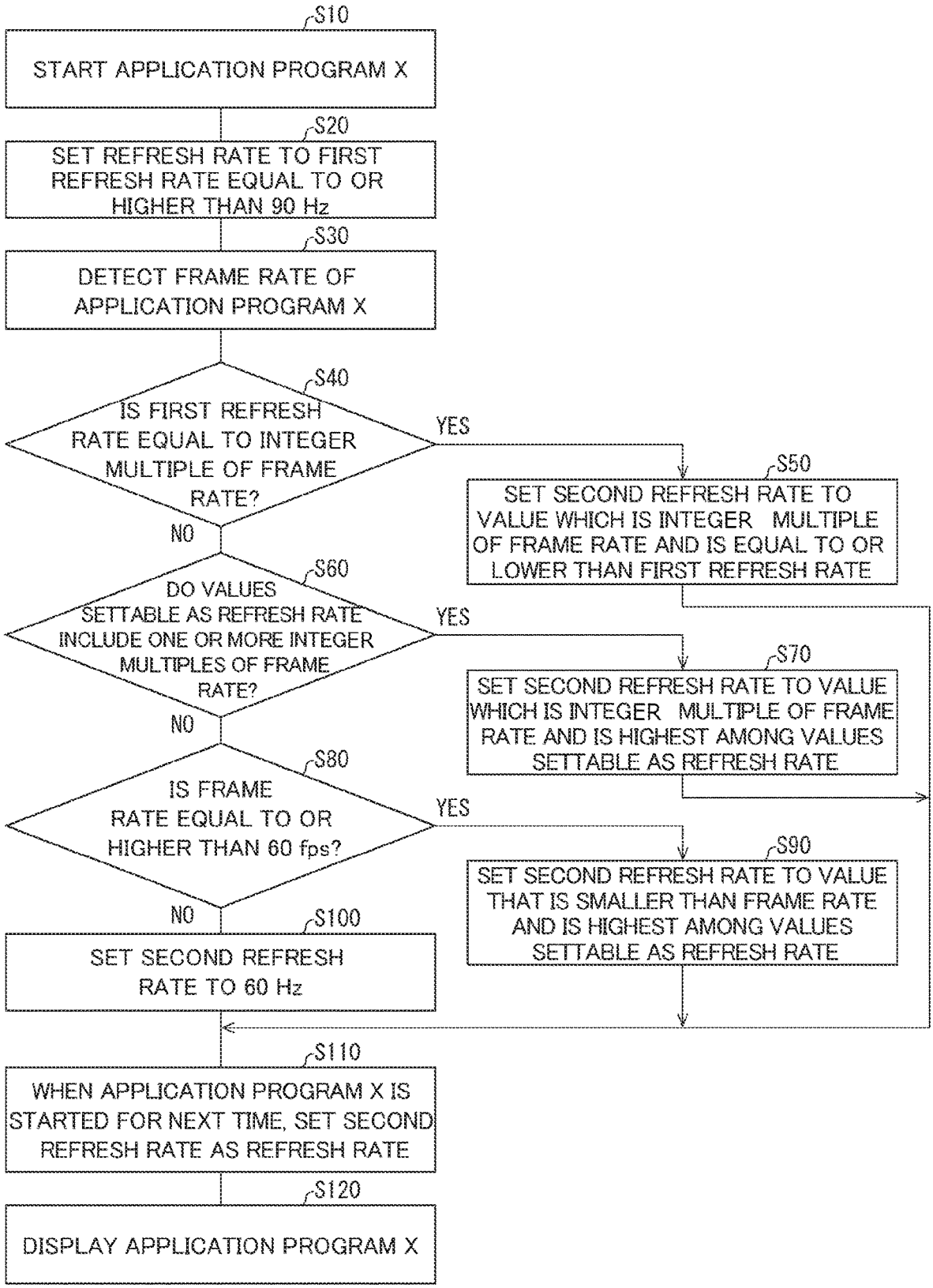
FIG. 2 is a flowchart of a method for setting a refresh rate according to the present disclosure.

Next, referring to FIG. 2, a flow of a method of setting the refresh rate in the portable terminal 1 is described below. FIG. 2 is a flowchart illustrating a method of setting the refresh rate in according to the present disclosure. In the following description, it is assumed that the application program X is started on the portable terminal 1.

First, in S10, the application program X is started on the portable terminal 1.

In S20, when the application program X is started, the first setting unit 4 sets the refresh rate of the display 7 to a first refresh rate equal to or higher than 90 Hz. More specifically, for example, the first setting unit 4 sets the first refresh rate to 120 Hz or 144 Hz, or the like.

In S30, the frame rate detection unit 2 detects the frame rate of the application program X.

In S40, the determination unit 5 determines whether the first refresh rate is an integer multiple of the frame rate of the application program X. In a case where the determination is Yes, the process proceeds to S50, but in a case where the determination is No, the process proceeds to S60.

In S50, the second setting unit 6 sets the second refresh rate to a value that is an integer multiple of the frame rate and is lower than or equal to the first refresh rate. The second setting unit 6 stores the set second refresh rate in the storage unit 8. Thereafter, the process proceeds to S110 (described below).

In S60, the determination unit 5 determines whether the settable refresh rates include one or more values equal to integer multiples of the frame rate. In a case where the determination is Yes, the process proceeds to S70, but in a case where the determination is No, the process proceeds to S80.

In S70, the second setting unit 6 sets the second refresh rate to a value that is an integer multiple of the frame rate and is lower than the first refresh rate. More specifically, as shown in FIG. 2, the second setting unit 6 may set the second refresh rate that is equal to an integer multiple of the frame rate and is highest among values settable as the refresh rate. The second setting unit 6 stores the set second refresh rate in the storage unit 8. Thereafter, the process proceeds to S110.

In S80, the determination unit 5 determines whether the frame rate is equal to or higher than 60 fps. In a case where the determination is Yes, the process proceeds to S90. However, in a case where the determination is No, the process proceeds to S100.

In S90, the second setting unit 6 sets the second refresh rate to a value that is smaller than the frame rate and is highest among values settable as the refresh rate. The second setting unit 6 stores the set second refresh rate in the storage unit 8. Thereafter, the process proceeds to S110.

In S100, the second setting unit 6 sets the second refresh rate to 60 Hz. The second setting unit 6 stores the set second refresh rate in the storage unit 8. Thereafter, the process proceeds to S110.

In S110, the refresh rate setting apparatus 3 reads the second refresh rate from the storage unit 8. When the application program X is started for the next time, the refresh rate setting apparatus 3 sets the refresh rate to the second refresh rate.

In S120, the display 7 displays the application program X at the second refresh rate.

The flow of the method of setting the refresh rate in the portable terminal 1 has been described above. By the method described above, the refresh rate setting apparatus 3 can improve the display quality of the portable terminal 1.

First Embodiment

A first embodiment of the present disclosure is described below.

Figures 3, 4:
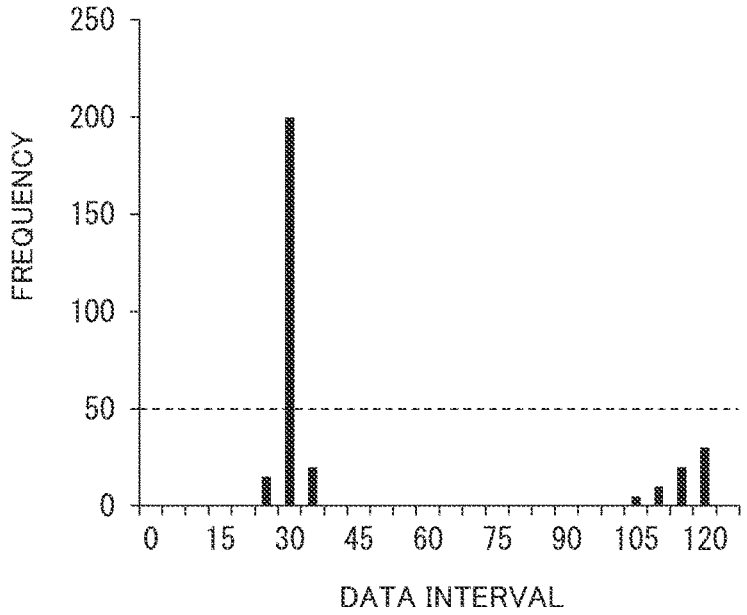
FIG. 3 is a diagram illustrating an example of data stored in a storage unit according to the present disclosure.
FIG. 4 illustrates an example of a histogram according to the present disclosure.

FIG. 3 is a diagram illustrating an example of data stored in the storage unit 8. The storage unit 8 stores pieces of data respectively indicating a name of an application program, a cumulative execution time of the application program (hours), a maximum frame rate (fps), a second refresh rate (Hz), a determination date of a determination by the determination unit 5, and an application program update date. In the storing by the storage unit 8, the second refresh rate (Hz) is stored in association with the data other than the second refresh rate (Hz).

Cumulative Execution Time

In a case where the storage unit 8 stores data indicating the cumulative execution time, the second setting unit 6 may set the second refresh rate based on the cumulative execution time as described below.

For example, in a case where the application program is a game program and the frame rate changes from one game scene to another, it may take a time to determine an appropriate frame rate. To handle this situation, a threshold value (a predetermined time) for the cumulative execution time is set, and the second setting unit 6 sets the second refresh rate when the cumulative execution time exceeds the threshold value. This allows the second setting unit 6 to set the second refresh rate to a more proper value. Thus, the refresh rate setting apparatus 3 can further improve the display quality of the portable terminal 1.

This technique is described below in further detail with reference to the application program 1 shown in FIG. 3. For the application program 1, the threshold value for the cumulative execution time is assumed to be set to 150 hours. In the example shown in FIG. 3, the cumulative execution time of the application program 1 is 100 hours. Therefore, at this point of time, the second setting unit 6 does not set the second refresh rate, but the second setting unit 6 sets the second refresh rate when the cumulative execution time exceeds 150 hours.

As described above, the second setting unit 6 may determine whether to set the second refresh rate based on the cumulative execution time. According to the technique described above, the refresh rate setting apparatus 3 can further improve the display quality of the portable terminal 1.

Determination Date

In a case where the storage unit 8 stores data indicating the determination date, the second setting unit 6 may set the second refresh rate based on the determination date as described below.

For example, let it be assumed that the application program is a game program and the frame rate varies as the game scene progresses. In this case, when a particular number of days have elapsed since the determination date, the game scene advances and a change occurs in the frame rate. Therefore, when the particular number of days have elapsed since the determination date, the storage unit 8 deletes the data associated with the application program. Thereafter, the second setting unit 6 re-sets the second refresh rate. This allows the second setting unit 6 to set the second refresh rate proper for game scenes. Thus, the refresh rate setting apparatus 3 can further improve the display quality of the portable terminal 1.

This technique is described in further detail below with reference to an application program 2 shown in FIG. 3. In the case of the application program 2, it is assumed that the storage unit 8 deletes the data associated with the application program 2 when a predetermined number of days (3 months) have elapsed since the determination date. In the example in FIG. 3, let it be assumed that three months have elapsed since the determination date (Nov. 15, 2019). In this case, the storage unit 8 deletes data associated with the application program 2, Thereafter, the second setting unit 6 re-sets the second refresh rate.

As described above, the second setting unit 6 may determine whether to set the second refresh rate based on the determination date. This makes it possible for the refresh rate setting apparatus 3 to further improve the display quality of the portable terminal 1.

Application Program Update Date

In a case where the storage unit 8 stores data indicating the application program update date, the second setting unit 6 may set the second refresh rate based on the application program update date as described below.

For example, let it be assumed that an application program is updated periodically. There is a possibility that the frame rate changes when the application program is updated. Therefore, when the application program is updated, the storage unit 8 deletes the data associated with the application program, Thereafter, the second setting unit 6 re-sets the second refresh rate. That is, the second setting unit 6 sets the second refresh rate appropriate for the updated application program. Thus, the refresh rate setting apparatus 3 can further improve the display quality of the portable terminal 1.

This technique is described in further detail below with reference to an application program 3 shown in FIG. 3. In this example, the update date of the application program 3 is Feb. 14, 2020. Therefore, on Feb. 14, 2020 or thereafter, the storage unit 8 deletes data associated with the application program 3. The storage unit 8 may delete the data associated with the application program 3 immediately after the application program 3 is updated, or when a predetermined number of days have passed since the application program update date. Thereafter, the second setting unit 6 re-sets the second refresh rate.

As described above, the second setting unit 6 may determine whether to set the second refresh rate based on the application program update date. This makes it possible for the refresh rate setting apparatus 3 to further improve the display quality of the portable terminal 1.

Some examples according to the first embodiment have been described above referring to FIG. 3. In the above-described examples, the cumulative execution time and/or the predetermined number of days from the determination date may be set automatically by the refresh rate setting apparatus 3 or may be manually set by a user. Next, a second embodiment is described below.

Second Embodiment

Internal Temperature of Portable Terminal 1

In a case where the internal temperature of the portable terminal 1 exceeds a predetermined temperature, a performance restriction may be placed on a function of the portable terminal 1 for the safety of a user. When the performance restriction is placed, a change may occur in the refresh rate of the display 7. If the refresh rate used when the performance restriction is placed is set as the second refresh rate, the display quality of the portable terminal 1 may be unstable when the performance restriction is released. To handle this situation, in a case where a temperature sensor disposed inside the portable terminal 1 indicates a predetermined temperature or higher, the storage unit 8 stops storing data.

According to the technique described above, when the temperature sensor disposed inside the portable terminal 1 indicates the predetermined temperature or higher, the storage unit 8 does not store the second refresh rate. Thus, the refresh rate used temporarily when the performance restriction is placed is not used after the performance restriction is released, which makes it possible for the portable terminal 1 to properly maintain the display quality.

Remaining Battery Capacity of Portable Terminal 1

When the refresh rate of the display 7 is high, the portable terminal 1 consumes high battery power, which affects the battery life. In view of the above, the second setting unit 6 may set the second refresh rate based on a remaining battery capacity of the portable terminal 1. For example, let it be assumed that the remaining battery capacity is lower than a predetermined value (for example, 50%) and the second setting unit 6 is allowed to set the second refresh rate to a plurality of values such as 60 Hz, 90 Hz, 120 Hz, and/or the like. In this case, the second setting unit 6 sets the second refresh rate to a smallest allowable value (60 Hz). This makes it possible for the refresh rate setting apparatus 3 to increase the charged battery life of the portable terminal 1.

As described above, the second setting unit 6 may set the second refresh rate based on the remaining battery capacity of the portable terminal 1. Thus, the refresh rate setting apparatus 3 can have a further effect of reducing the battery consumption of the portable terminal 1.

Third Embodiment

Next, a third embodiment of the refresh rate setting apparatus 3 according to the present disclosure is described. In a case where the display 7 is operable at refresh rates of 60 Hz and 120 Hz, the second setting unit 6 may set the second refresh rate as follows.

(1) The refresh rate of the display 7 is maintained at 120 Hz without being updated until the cumulative execution time of the application program exceeds a predetermined time (for example, 10 hours).

(2) In a case where the frame rate of the application program is equal to or higher than 110 fps, the refresh rate of the display 7 is maintained at 120 Hz without being updated.

(3) In a case where the first refresh rate is not an integer multiple of the frame rate, the refresh rate of the display 7 is updated to 60 Hz.

(4) In a case where the first refresh rate is an integer multiple of the frame rate, the refresh rate of the display 7 is maintained at 120 Hz without being updated.

In any of (1) to (4) described above, a reduction in jerky movement of an image displayed on the display screen of the portable terminal 1 is achieved. That is, the refresh rate setting apparatus 3 can improve the display quality of the portable terminal 1. Furthermore, by determining the refresh rate according to predetermined rules (1) to (4), it also becomes possible to reduce the load on the CPU 9.

Fourth Embodiment

Next, a fourth embodiment of the refresh rate setting apparatus 3 according to the present disclosure is described. In a case where the display 7 is operable at refresh rates of 60 Hz and 120 Hz, the second setting unit 6 may set the second refresh rate as follows.

(1) The refresh rate of the display 7 is maintained at 120 Hz without being updated until the cumulative execution time of the application program exceeds a predetermined time (for example, 10 hours).

(2) In a case where the frame rate of the application program is equal to or higher than 110 fps, the refresh rate of the display 7 is maintained at 120 Hz without being updated.

(3) In a case where the first refresh rate is not an integer multiple of the frame rate, the refresh rate of the display 7 is updated to 60 Hz.

(4) In a case where the first refresh rate is an integer multiple of the frame rate, the refresh rate of the display 7 is updated to 60 Hz.

In any of (1) to (4) described above, a reduction in jerky movement of an image displayed on the display screen of the portable terminal 1 is achieved. That is, the refresh rate setting apparatus 3 can improve the display quality of the portable terminal 1. Furthermore, by determining the refresh rate according to predetermined rules (1) to (4), it also becomes possible to reduce the load on the CPU 9.

Fifth Embodiment

Next, a fifth embodiment of the refresh rate setting apparatus 3 according to the present disclosure is described. In a case where the display 7 is operable at refresh rates of 60 Hz and 120 Hz, the second setting unit 6 may set the second refresh rate as follows.

(1) The refresh rate of the display 7 is maintained at 120 Hz without being updated until the cumulative execution time of the application program exceeds a predetermined time (for example, 10 hours).

(2) In a case where the frame rate of the application program is equal to or higher than 110 fps, the refresh rate of the display 7 is maintained at 120 Hz without being updated.

(3) In a case where the first refresh rate is not an integer multiple of the frame rate, depending on a characteristic of the display 7 or an appearance of an image displayed on the display 7, the refresh rate of the display 7 is maintained at 120 Hz without being updated.

(4) In a case where the first refresh rate is an integer multiple of the frame rate, the refresh rate of the display 7 is maintained at 120 Hz without being updated.

In any of (1) to (4) described above, a reduction in jerky movement of an image displayed on the display screen of the portable terminal 1 is achieved. That is, the refresh rate setting apparatus 3 can improve the display quality of the portable terminal 1. Furthermore, by determining the refresh rate according to predetermined rules (1) to (4), it also becomes possible to reduce the load on the CPU 9.

Sixth Embodiment

Next, a sixth embodiment of the refresh rate setting apparatus 3 according to the present disclosure is described. In a case where the display 7 is operable at refresh rates of 60 Hz, 90 Hz, and 120 Hz, the second setting unit 6 may set the second refresh rate as follows.

(1) The refresh rate of the display 7 is maintained at 120 Hz without being updated until the cumulative execution time of the application program exceeds a predetermined time (for example, 10 hours).

(2) In a case where the frame rate of the application program is equal to or higher than 110 fps, the refresh rate of the display 7 is maintained at 120 Hz without being updated.

(3) In a case where the first refresh rate is not an integer multiple of the frame rate and the settable refresh rates include one or more values equal to integer multiples of the frame rate, the refresh rate of the display 7 is set to an integer multiple of the frame rate.

(4) In a case where the first refresh rate is not an integer multiple of the frame rate and the frame rate is equal to or higher than 80 fps and lower than 110 fps, the refresh rate of the display 7 is updated to 90 Hz.

(5) In a case where the first refresh rate is not an integer multiple of the frame rate and the frame rate is lower than 80 fps, the refresh rate of display 7 is updated to 60 Hz.

(6) In a case where the first refresh rate is an integer multiple of the frame rate, the refresh rate of the display 7 is maintained at 120 Hz without being updated.

In any of (1) to (6) described above, a reduction in jerky movement of an image displayed on the display screen of the portable terminal 1 is achieved. That is, the refresh rate setting apparatus 3 can improve the display quality of the portable terminal 1. Furthermore, by determining the refresh rate according to predetermined rules (1) to (6), it also becomes possible to reduce the load on the CPU 9.

Seventh Embodiment

Next, a seventh embodiment of the refresh rate setting apparatus 3 according to the present disclosure is described. In a case where the display 7 is operable at refresh rates of 60 Hz, 120 Hz, and 150 Hz, the second setting unit 6 may set the second refresh rate as follows. In this example, the first refresh rate is assumed to be equal to 120 Hz.

(1) The refresh rate of the display 7 is maintained at 120 Hz without being updated until the cumulative execution time of the application program exceeds a predetermined time (for example, 10 hours).

(2) In a case where the frame rate of the application program is equal to or higher than 110 fps, the refresh rate of the display 7 is maintained at 120 Hz without being updated.

(3) In a case where the first refresh rate is not an integer multiple of the frame rate and the settable refresh rates include one or more values equal to integer multiples of the frame rate, the refresh rate of the display 7 is set to an integer multiple of the frame rate.

(4) In a case where the first refresh rate is not an integer multiple of the frame rate, the refresh rate of the display 7 is updated to 60 Hz.

(5) In a case where the first refresh rate is an integer multiple of the frame rate, the refresh rate of the display 7 is maintained at 120 Hz without being updated.

In any of (1) to (5) described above, a reduction in jerky movement of an image displayed on the display screen of the portable terminal 1 is achieved. That is, the refresh rate setting apparatus 3 can improve the display quality of the portable terminal 1. Furthermore, by determining the refresh rate according to predetermined rules (1) to (5), it also becomes possible to reduce the load on the CPU 9.

Eighth Embodiment

Next, an eighth embodiment of the refresh rate setting apparatus 3 according to the present disclosure is described. In a case where the display 7 is operable at refresh rates of 60 Hz, 120 Hz, and 150 Hz, the second setting unit 6 may set the second refresh rate as follows. In this example, the first refresh rate is assumed to be equal to 150 Hz.

(1) The refresh rate of the display 7 is maintained at 150 Hz without being updated until the cumulative execution time of the application program exceeds a predetermined time (for example, 10 hours).

(2) In a case where the frame rate of the application program is equal to or higher than 140 fps, the refresh rate of the display 7 is maintained at 150 Hz without being updated.

(3) In a case where the first refresh rate is not an integer multiple of the frame rate and the settable refresh rates include one or more values equal to integer multiples of the frame rate, the refresh rate of the display 7 is set to an integer multiple of the frame rate.

(4) In a case where the first refresh rate is not an integer multiple of the frame rate and the frame rate is equal to higher than 110 fps and lower than 140 fps, the refresh rate of display 7 is updated to 120 Hz.

(5) In a case where the first refresh rate is not an integer multiple of the frame rate and the frame rate is lower than 110 fps, the refresh rate of display 7 is updated to 60 Hz.

(6) In a case where the first refresh rate is an integer multiple of the frame rate, the refresh rate of the display 7 is maintained at 150 Hz without being updated.

In any of (1) to (6) described above, a reduction in jerky movement of an image displayed on the display screen of the portable terminal 1 is achieved. That is, the refresh rate setting apparatus 3 can improve the display quality of the portable terminal 1. Furthermore, by determining the refresh rate according to predetermined rules (1) to (6), it also becomes possible to reduce the load on the CPU 9.

Ninth Embodiment

Next, a ninth embodiment of the refresh rate setting apparatus 3 according to the present disclosure is described.

There is a possibility that an application program does not operate at a specified frame rate on the portable terminal 1. For example, an application program (for example, a game program), which operates at a frame rate of 30 fps in a normal state, may operate at a frame rate different from 30 fps when a game screen is switched or loaded. In such a case, the frame rate detection unit 2 may exclude a particular frame rate from the detected frame rates by a method described below.

(1) The frame rate detection unit 2 calculates a histogram and excludes frame rates that are outside a specified range of the histogram. For example, let it be assumed that the frame rate detection unit 2 detects a frame rate of 20 fps when the specified range of the histogram is 40 fps to 70 fps. In this case, the frame rate detection unit 2 ignores 20 fps in counting.

(2) The frame rate detection unit 2 calculates the histogram and excludes frame rates that are outside the specified frequency range of the histogram. A further description of this technique is given below with reference to FIG. 4.

FIG. 4 illustrates an example of a histogram according to the present disclosure. A horizontal axis indicates a data interval. A vertical axis indicates a frequency. For example, in a case where the frame rate is detected once per second for 5 minutes and the histogram is calculated with 5-frame intervals, a specified frequency is defined as a "range equal to or higher than 60". In counting, the frame rate detection unit 2 ignores frame rates with frequencies lower than 60. In the example in FIG. 4, the count of 30 fps is higher than or equal to the specified frequency, that is, 60 counts, while the counts of the other frame rates are smaller than 60 counts. Therefore, the frame rate detection unit 2 accepts only the frame rate of 30 fps in counting.

(3) In a case where frame rates detected for a predetermined period of time (for example, 5 seconds) include a value that is outside of a predetermined range of frame rate (for example, 25 fps), the frame rate detection unit 2 excludes the frame rate is outside the predetermined range. For example, in a case where the frame rate detection unit 2 detects frame rates of "60 fps, 60 fps, 60 fps, 60 fps, 60 fps, 120 fps, 120 fps, 60 fps, 60 fps, 60 fps" in 5 seconds, the frame rate detection section 2 ignores the frame rate of 120 fps, which is detected twice, in counting.

In any of (1), (2), and (3) described above, a reduction in jerky movement of an image displayed on the display screen of the portable terminal 1 is achieved. That is, the refresh rate setting apparatus 3 can improve the display quality of the portable terminal 1.

Examples of Implementation by Software

Control blocks (in particular, the first setting unit 4, the determination unit 5, and the second setting unit 6) of the refresh rate setting apparatus 3 may be realized by logic circuits (hardware) formed in an integrated circuit (an IC chip) or the like, or may be realized by software.

In the latter case, the refresh rate setting apparatus 3 includes a computer that executes instructions of a computer program, which is software that realizes a function. The computer includes at least one processor (a control apparatus) or the like and at least one computer-readable storage medium in which the program is stored. In the computer, the processor reads the program from the storage medium and executes the program, thereby accomplishing an aspect of the present disclosure. For example, a CPU (Central Processing Unit) may be used as the processor. The storage medium may be a "non-transitory tangible medium", such as a read-only memory (ROM), a tape, a disk, a card, a semiconductor memory, a programmable logic circuit, or the like. A RAM (Random Access Memory) or the like for loading the program may also be provided. Alternatively, the program may be supplied to the computer via a transmission medium (a communication network, a broadcast wave, or the like) capable of transmitting the program. Note that an aspect of the present disclosure may also be realized in the form of a data signal embedded in a carrier wave such that the program is embodied by electronic transmission.

The refresh rate setting apparatus 3 according to any one of aspects of present disclosure may be realized by a computer. In this case, a control program that causes the computer to operate as various units (software elements) of the refresh rate setting apparatus 3 thereby realizing the refresh rate setting apparatus 3 on the computer, and a computer-readable storage medium in which the control program is stored also fall within the scope of an aspect of the present disclosure.

Summary of Embodiments

Aspect 1

Aspect 1 of the present disclosure provides a refresh rate setting apparatus for use in a portable terminal, including a first setting unit configured to, when an application program is started, set a refresh rate of a display of the portable terminal to a first refresh rate equal to or higher than 90 Hz, a determination unit configured to determine whether the first refresh rate is an integer multiple of a frame rate of the application program, and a second setting unit configured to, in a case where the determination unit determines that the first refresh rate is not an integer multiple of the frame rate, set the refresh rate to a second refresh rate according to whether values settable as the refresh rate include one or more values each equal to an integer multiple of the frame rate.

According to this aspect, the refresh rate setting apparatus can further improve the display quality.

Aspect 2

In the refresh rate setting apparatus according to Aspect 2 of the present disclosure, based on Aspect 1, in a case where the values settable as the refresh rate do not include an integer multiple of the frame rate and the frame rate is equal to or higher than 60 fps, the second setting unit may set, as the second refresh rate, a value that is lower than the frame rate and is highest among values settable as the refresh rate.

According to this aspect, the refresh rate setting apparatus can further improve the display quality.

Aspect 3

In the refresh rate setting apparatus according to Aspect 3 of the present disclosure, based on Aspect 1, in a case where the values settable as the refresh rate do not include an integer multiple of the frame rate and the frame rate is lower than 60 fps, the second setting unit may set the second refresh rate to 60 Hz.

According to this aspect, the refresh rate setting apparatus can further improve the display quality.

Aspect 4

In the refresh rate setting apparatus according to Aspect 4 of the present disclosure, based on Aspect 1, in a case where the values settable as the refresh rate include one or more values each equal to an integer multiple of the frame rate, the second setting unit may set, as the second refresh rate, a value that is an integer multiple of the frame rate and is highest among values settable as the refresh rate.

According to this aspect, the refresh rate setting apparatus can further improve the display quality.

Aspect 5

In the refresh rate setting apparatus according to Aspect 5 of the present disclosure, based on Aspect 1, in a case where the determination unit determines that the first refresh rate is an integer multiple of the frame rate of the application program, the second setting unit may set, as the second refresh rate, a value that is an integer multiple of the frame rate and is equal to or lower than the first refresh rate.

According to this aspect, the refresh rate setting apparatus can further improve the display quality.

Aspect 6

In the refresh rate setting apparatus according to Aspect 6 of the present disclosure, based on one of Aspects 1 to 5, when the application program is started for the next time, the second refresh rate may be set as the refresh rate.

The refresh rate setting apparatus determines the refresh rate of the display not when the application program is running but when the application program is started. This makes it possible for the portable terminal to have a further reduction in jerky movement in an image displayed on the display screen. Thus, the refresh rate setting apparatus is capable of further improving the display quality of the portable terminal.

Aspect 7

The refresh rate setting apparatus according to Aspect 7 of the present disclosure, based on one of Aspects 1 to 6 may further include a storage unit configured to store the second refresh rate, wherein the second refresh rate stored in the storage unit may be read as the refresh rate.

According to this aspect, it is possible to store the second refresh rate over a long period of time and refer to it.

Aspect 8

In the refresh rate setting apparatus according to Aspect 8 of the present disclosure, based on Aspect 7, the storage unit may store the second refresh rate and, in association with the second refresh rate, at least one of followings: a name of the application program; a cumulative execution time of the application program; a maximum frame rate indicating a maximum value of the frame rate; a determination date of making a determination by the determination unit; and an update date of the application program.

According to this aspect, various kinds of data are stored in association with the second refresh rate, and thus it becomes possible to more flexibly set the second refresh rate, as described below.

Aspect 9

In the refresh rate setting apparatus according to Aspect 9 of the present disclosure, based on Aspect 8, in a case where the storage unit stores the cumulative execution time and the cumulative execution time exceeds a predetermined time, the second refresh rate may be set as the refresh rate.

According to this aspect, for example, in a case where the frame rate of the application program changes from one scene to another, an appropriate frame rate is determined and the refresh rate is determined based on the frame rate. This makes it possible for the refresh rate setting apparatus to further improve the display quality of the portable terminal.

Aspect 10

In the refresh rate setting apparatus according to Aspect 10 of the present disclosure, based on Aspect 8, in a case where the storage unit stores the determination date and a predetermined number of days have elapsed since the determination date, the storage unit may delete data related to the application program.

According to this aspect, for example, in a case where the frame rate of the application program changes from one scene to another, the refresh rate may be set before the predetermined number of days have elapsed since the determination date. This makes it possible for the refresh rate setting apparatus to further improve the display quality of the portable terminal.

Aspect 11

In the refresh rate setting apparatus according to Aspect 11 of the present disclosure, based on Aspect 8, in a case where the storage unit stores the determination date and the application program is updated on or after the determination date, the storage unit may delete data related to the application program.

According to this aspect, when the application program is updated, the refresh rate set after the update date may be used. This makes it possible for the refresh rate setting apparatus to further improve the display quality of the portable terminal.

Aspect 12

In the refresh rate setting apparatus according to Aspect 12 of the present disclosure, based on one of Aspects 7 to 11, in a case where an internal temperature of the portable terminal exceeds a predetermined value, the storage unit may stop storing data.

According to this aspect, when the internal temperature of the portable terminal exceeds the predetermined value, and the performance restriction is placed on the portable terminal, the refresh rate employed in this situation is not used, and thus it is possible properly maintain the display quality of the portable terminal.

Aspect 13

In the refresh rate setting apparatus according to Aspect 13 of the present disclosure, based on one of Aspects 1 to 12, the second refresh rate may be set based on a remaining battery capacity of the portable terminal.

According to this aspect, it is possible to achieve a further effect of reducing the battery consumption of the portable terminal.

Aspect 14

Aspect 14 of the present disclosure provides a method for setting a refresh rate of a portable terminal, including when an application program is started, setting a refresh rate of a display of the portable terminal to a first refresh rate equal to or higher than 90 Hz, determining whether the first refresh rate is an integer multiple of a frame rate of the application program, in a case where it is determined that the first refresh rate is not an integer multiple of the frame rate, further determining whether values settable as the refresh rate include one or more values each equal to an integer multiple of the frame rate, in a case where the values settable as the refresh rate do not include an integer multiple of the frame rate and the frame rate is equal to or higher than 60 fps, setting, as a second refresh rate, a value that is lower than the frame rate and is highest among values settable as the refresh rate, in a case where the values settable as the refresh rate do not include an integer multiple of the frame rate and the frame rate is lower than 60 fps, setting the second refresh rate to 60 Hz, and when the application program is started for the next time, setting the second refresh rate as the refresh rate.

According to this aspect, it is possible to achieve effects similar to those achieved by the refresh rate setting apparatus.

Aspect 15

Aspect 15 of the present disclosure provides a refresh rate setting program for causing a computer to function as the refresh rate setting apparatus according to Aspect 1, wherein the refresh rate setting program is configured to cause the computer to function as the first setting unit, the determination unit, and the second setting unit.

According to this aspect, it is possible to achieve effects similar to those achieved by the refresh rate setting apparatus.

The present disclosure contains subject matter related to that disclosed in Japanese Priority Patent Application JP 2020-023829 filed in the Japan Patent Office on Feb. 14, 2020, the entire contents of which are hereby incorporated by reference.

Note that the present disclosure is not limited to embodiments described above, and various modifications are possible within the scope described in claims. Embodiments obtained by combining the technical means disclosed in the embodiments also fall within the technical scope of the present disclosure. A new technical feature may be achieved by combining technical means disclosed in the embodiments. While there have been described what are at present considered to be certain embodiments of the invention, it will be understood that various modifications may be made thereto, and it is intended that the appended claims cover all such modifications as fall within the true spirit and scope of the invention.

What is claimed is:

1. A refresh rate setting apparatus for use in a portable terminal, comprising:

a first setting unit configured to, when an application program is started, set a refresh rate of a display of the portable terminal to a first refresh rate equal to or higher than 90 Hz;

a determination unit configured to determine whether the first refresh rate is an integer multiple of a frame rate of the application program, and, in a case where the determination unit determines that the first refresh rate is not the integer multiple of the frame rate, configured to determine whether values settable as the refresh rate include one or more values each equal to the integer multiple of the frame rate; and a second setting unit configured to set the refresh rate to a second refresh rate according to whether the values settable as the refresh rate include the one or more values each equal to the integer multiple of the frame rate.

2. The refresh rate setting apparatus according to claim 1, wherein in a case where the values settable as the refresh rate do not include the integer multiple of the frame rate and the frame rate is equal to or higher than 60 fps, the second setting unit sets, as the second refresh rate, a value that is lower than the frame rate and is highest among values settable as the refresh rate.

3. The refresh rate setting apparatus according to claim 1, wherein in a case where the values settable as the refresh rate do not include the integer multiple of the frame rate and the frame rate is lower than 60 fps, the second setting unit sets the second refresh rate to 60 Hz.

4. The refresh rate setting apparatus according to claim 1, wherein in a case where the values settable as the refresh rate include one or more values each equal to the integer multiple of the frame rate, the second setting unit sets, as the second refresh rate, a value that is the integer multiple of the frame rate and is lower than the first refresh rate.

5. The refresh rate setting apparatus according to claim 1, wherein in a case where the determination unit determines that the first refresh rate is the integer multiple of the frame rate of the application program, the second setting unit sets, as the second refresh rate, a value that is the integer multiple of the frame rate and is lower than the first refresh rate.

6. The refresh rate setting apparatus according to claim 1, wherein when the application program is started for the next time, the second refresh rate is set as the refresh rate.

7. The refresh rate setting apparatus according to claim 1, further comprising a storage unit configured to store the second refresh rate, wherein the second refresh rate stored in the storage unit is read as the refresh rate.

8. The refresh rate setting apparatus according to claim 7, wherein the storage unit stores the second refresh rate and, in association with the second refresh rate, at least one of followings: a name of the application program; a maximum frame rate indicating a maximum value of the frame rate; and an update date of the application program.

9. The refresh rate setting apparatus according to claim 7, wherein the storage unit stores the second refresh rate and, in association with the second refresh rate, a cumulative execution time of the application program, and the cumulative execution time exceeds a predetermined time, the second refresh rate is set as the refresh rate.

10. The refresh rate setting apparatus according to claim 7, wherein the storage unit stores the second refresh rate and, in association with the second refresh rate, a determination date of making a determination by the determination unit and a predetermined number of days have elapsed since the determination date, the storage unit deletes data related to the application program.

11. The refresh rate setting apparatus according to claim 7, wherein the storage unit stores the second refresh rate and, in association with the second refresh rate, a determination date of making a determination by the determination unit and the application program is updated on or after the determination date, the storage unit deletes data related to the application program.

12. The refresh rate setting apparatus according to claim 7, wherein in a case where an internal temperature of the portable terminal exceeds a predetermined value, the storage unit stops storing data.

13. The refresh rate setting apparatus according to claim 1, wherein the second refresh rate is set based on a remaining battery capacity of the portable terminal.

14. A computer-readable non-transitory storage medium storing a refresh rate setting program for causing a computer to function as the refresh rate setting apparatus according to claim 1, wherein the refresh rate setting program is configured to cause the computer to function as the first setting unit, the determination unit, and the second setting unit.

15. A method for setting a refresh rate of a portable terminal, comprising:

when an application program is started, setting a refresh rate of a display of the portable terminal to a first refresh rate equal to or higher than 90 Hz;

determining whether the first refresh rate is an integer multiple of a frame rate of the application program;

in a case where it is determined that the first refresh rate is not the integer multiple of the frame rate, further determining whether values settable as the refresh rate include one or more values each equal to the integer multiple of the frame rate;

in a case where the values settable as the refresh rate do not include the integer multiple of the frame rate and the frame rate is equal to or higher than 60 fps, setting, as a second refresh rate, a value that is lower than the frame rate and is a maximum value settable as the refresh rate;

in a case where the values settable as the refresh rate do not include the integer multiple of the frame rate and the frame rate is lower than 60 fps, setting the second refresh rate to 60 Hz; and when the application program is started for the next time, setting the second refresh rate as the refresh rate.

* * * * *